United States Patent [19]

Hansel

[11] 4,108,223

[45] Aug. 22, 1978

[54] VAPOR RECEIVING SYSTEM FOR A DISPENSING NOZZLE

[75] Inventor: William B. Hansel, Media, Pa.

[73] Assignee: Suntech, Inc., St. Davids, Pa.

[21] Appl. No.: 664,445

[22] Filed: Mar. 8, 1976

[51] Int. Cl.[2] ..... B65B 3/04

[52] U.S. Cl. ..... 141/392

[58] Field of Search ..... 141/39-44, 141/52, 59, 97, 290, 310, 382, 383, 384, 387, 388, 311, 390, 392, 287, 307, 385, 386; 285/263, 272, 9 M; 138/121, 173

[56] References Cited

U.S. PATENT DOCUMENTS

| | | | |
|---|---|---|---|
| 3,840,055 | 10/1974 | Wostl et al. | 141/392 |
| 3,899,009 | 2/1973 | Taylor | 141/DIG. 1 |

FOREIGN PATENT DOCUMENTS

| | | | |
|---|---|---|---|
| 1,445,944 | 6/1966 | France | 138/121 |

*Primary Examiner*—Houston S. Bell, Jr.

*Attorney, Agent, or Firm*—J. Edward Hess; Donald R. Johnson; Paul Lipsitz

[57] ABSTRACT

An improved vapor receiving system for a gasoline dispensing nozzle having a stronger magnetic sealing section and a more flexible and durable bellows construction. The magnetic sealing section has a magnetic ring backed by a second ring attracted to the magnet which acts as a pole piece to increase the magnetic attractions toward the fillpipe during the filling and vapor receiving process. The magnetic sealing section cover and bellows section are made from a thin, flexible reinforcement mesh impregnated with natural or synthetic elastomer such as vinyl.

24 Claims, 3 Drawing Figures

FIG. 1.
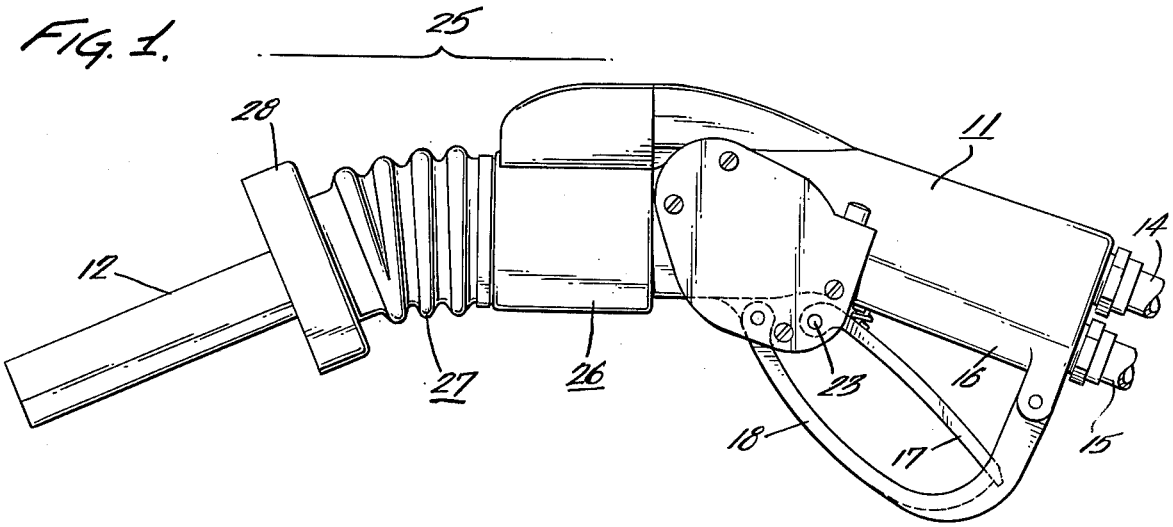
FIG. 2.
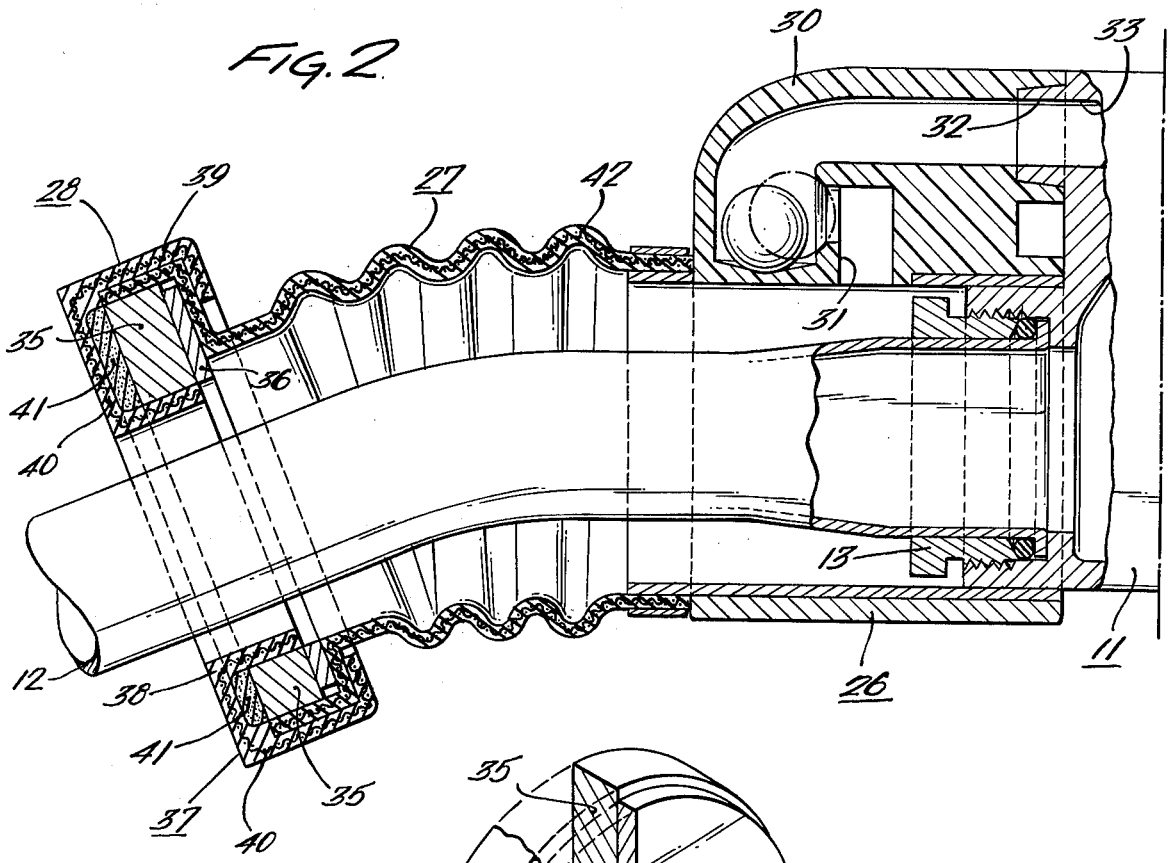
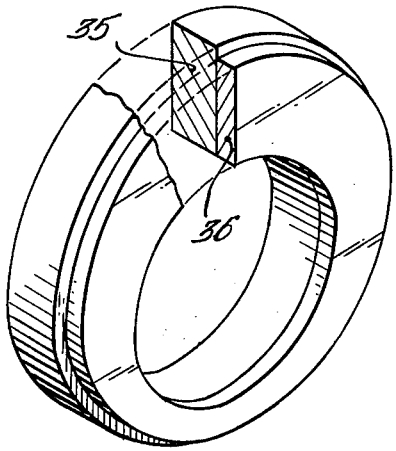
FIG. 3.

VAPOR RECEIVING SYSTEM FOR A DISPENSING NOZZLE

BACKGROUND OF THE INVENTION

This invention is related to vapor receiving systems for use on gasoline dispensing nozzles and more particularly to a vapor receiving system which has a magnetic seal for contacting the fillpipe of the vehicle and a flexible bellows section.

Current environmental regulations will require in some areas that gasoline vapors displaced from a vehicle fuel tank being filled are to be recovered in order to prevent their escape into the atmosphere. One method of complying with this requirement is to have a closed filling system where the vapors displaced from the fuel tank are forced back into the underground hydrocarbon storage tanks. One problem encountered with this direct displacement system is obtaining a tight seal on the fillpipe of the vehicle so that the vapors are displaced into the vapor receiving system and back into the underground tanks rather than out into the atmosphere.

Another problem is obtaining a sealing surface for the vapor receiving system which is durable enough to withstand continuous use for several months without repair, and still maintain its sealing ability. Remedying this problem is complicated further when a magnetic device is used to hold the sealing surface of the vapor receiving system against the fillpipe, since the thicker the sealer surface becomes, the more the magnetic force is reduced.

To further aid in permitting the sealing surface of the vapor receiving system to contact the fillpipe, it is desirable to have the bellows portion of the vapor receiving system as flexible as possible, but yet durable enough to withstand continuous compression from use for several months without developing leaks.

SUMMARY OF THE INVENTION

In accordance with a preferred embodiment a vapor receiving system is provided which includes an improved magnetic sealing section and bellows section. The magnetic sealing section has a magnetic ring with a flat, pole piece located on its backside and a thin, flexible cover for the magnetic disc with a smooth, durable sealing face formed from a reinforcement means, or a mesh, impregnated or coated with natural or synthetic elastomers to form a flexible layer. The vapor receiving chamber includes flexible bellows also formed out of a reinforcing means, or flexible mesh, impregnated with natural or synthetic elastomers to form a flexible layer.

The pole piece on the back side of the magnetic ring acts to concentrate the magnetic force of the magnet mostly in the forward direction, or toward the fillpipe when using the nozzle. Use of an impregnated flexible mesh permits a very thin flexible cover to be used over the magnetic ring which can provide an improved sealing relationship between the vapor receiving system and a vehicle fillpipe with the necessary durability required for continuous use without materially reducing the magnetic forces from the magnet. In addition, the use of the impregnated flexible mesh for the vapor receiving bellows provides a very strong yet flexible bellows design which can better withstand continuous use.

A better understanding of the invention and its advantages can be seen in the following description of the figures and preferred embodiment.

DESCRIPTION OF THE FIGURES AND PREFERRED EMBODIMENT

FIG. 1 is an elevational view depicting the outside appearance of a typical gasoline dispensing nozzle with the vapor receiving system of this invention.

FIG. 2 is an enlarged, partial sectional view of the nozzle in FIG. 1 showing the construction of the vapor receiving system.

FIG. 3 is a pictorial view illustrating the placement of the pole piece on the magnet.

For purposes of describing the vapor receiving system herein, the nozzle illustrated in the drawing is similar to that disclosed by E. T. Young in U.S. Pat. No. 3,734,339 and will be used herein for illustrative purposes.

Referring to the Figures, a general explanation of the nozzle and the vapor receiving system will be made. The nozzle assembly has a housing 11 with a discharge spout 12 connected thereto by retaining nut 13. Vapor return hose 14 and gasoline supply hose 15 connect to handle portion 16 of housing 11. Operation of the nozzle is accomplished by squeezing lever 17 against handle 16. Guard 18 acts to protect actuating lever 17 as well as to provide a support for holding the nozzle when it is inserted into the island pump. A more detailed explanation of the operation of this nozzle is contained in the above Young patent.

The vapor receiving system is generally denoted by the numeral 25 and encompasses the elements under the bracket associated with numeral 25 which form a vapor receiving chamber into which the vapors are displaced from the vehicle fuel tank. Vapor receiving chamber 25 includes three general sections, non-flexible housing 26, flexible bellows 27, and magnetic sealing section 28. Mounted on the top of non-flexible housing 26 is an attitude valve system, generally denoted by the numeral 30, which is connected at its inlet end 31 to the inside of non-flexible housing 26 and at its outlet 32 to the vapor return passageway 33, located inside nozzle housing 11 and connected to vapor return hose 14. The flow path formed by attitude valve 30, vapor return passageway 33, and vapor return hose 44 will be generally referred to in this application as the vapor return line which connects the underground storage tanks.

Attitude valve 30 is designed so that when a nozzle is placed in its dispensing position, vapors flow through the valve itself and back into the underground storage tanks through vapor return passageway 33 and vapor return hose 14. When the nozzle is placed in an upward position, such as when it is placed on the pump housing, the valve then obtains a closed position such that no vapors can flow from the underground tanks into the atmosphere through the vapor return line. Particular features of an attitude valve similar to valve 30 are discussed in detail in the copending application entitled "Attitude Valve for Gasoline Dispensing Nozzle With A Vapor Receiving System", Ser. No. 609,761, filed Sept. 2, 1975.

Referring to FIG. 2, sealing section 28 includes a flat, magnetic ring 35 having a ferrous pole piece 36 located on its back side, which does not face the fillpipe. Pole piece 36 is held in place by the magnetic forces of magnet 35 and acts to bend the magnetic field in such a manner that more magnetic attraction is experienced on the front side of the magnetic disc 35, thereby increasing the magnetic attraction toward the fillpipe when dispensing gasoline.

A cover for the front side of magnet 35 is necessary to assure that a tight seal is obtained between vapor receiving chamber 25 and the fillpipe of the vehicle being filled. However, this cover should be thin enough to not appreciably affect the magnetic forces from magnetic disc 35. A cover design which enables this qualification to be met will now be described. It is noted that in FIG. 2, the thickness of cover 37 and bellows 27 is exaggerated for illustrative purposes and does not necessarily indicate a preferred size relative to the size of the remaining structures.

Cover 37 has a thin flexible face 38 which covers the front side of magnet 35 and an outer edge 39 which extends around the outside edge of magnet 35 and to the backside of pole piece 36. Cover 37 also extends around the inside diameter of the opening in magnet 35. To enable face 38 to be as thin as is practically possible, it can be formed from a reinforcement means, such as mesh 40, impregnated or coated with a flexible material in such a manner that mesh 40 forms the internal structure of face 38. If desired, for additional strength, cover 37 can be formed with mesh 40 extending throughout its structure.

To better utilize the flexibility of face surface 38, a thin layer of sponge-like or foam material 41 can be sandwiched between face 38 and the front side of magnet 35. In this manner, resiliency is applied to face 38 to better enable it to conform to the particular surface features of a fillpipe opening.

Use of a similar structure as described for cover 37 in the construction of bellows 27 also provides increased durability and flexibility for the bellows as compared to a bellows formed from a single material. Since bellows 26 is compressed each time the nozzle is used, it is likely to develop weaknesses and cracks at the bends in the convolutions with continuous use. Use of a reinforcement means, such as mesh 42 in bellows 27, permits the required degree of flexibility to be obtained with the resistance to normal wear of the bellows sections being equal to or greater than those bellows having a single layer of flexible material.

The reinforcement means is preferably in the form of a flexible mesh formed out of a synthetic thermoplastic polymer and more preferably formed from the class of polyamides such as "nylon 6" or "nylon 6/6". However, polyolefins, polystyrenes, or polyesters could also be used to form the mesh. Also, natural fibers forming a cloth mesh could be used as the reinforcing means. The mesh can be in the form of a woven material having the strands woven together or can be in lattice shape wherein the strands are connected to each other.

The impregnating agent can be any material which achieves a flexible consistency which is also resistant to hydrocarbon vapors, such as natural and synthetic elastomers. Included in this class would be both natural and synthetic rubber as well as synthetic thermoplastic polymers.

Using a nylon mesh impregnated with polyvinylchloride permits a thin, flexible layer to be produced which has the smoothness, strength, and durability required for cover 37 and bellows 27. With this combination, the materials costs for mass producing a vapor receiving system could be less than that for systems using only flexible material without any reinforcing means, since greater thickness would be required to achieve an equivalent strength, but at the expense of flexibility.

With face surface 38 for cover 37 made from the thin reinforced flexible material, the face surface can easily adapt to the particular contour of each fillpipe in order to properly seal the vapor receiving system to the end of the fillpipe. When using a magnetic sealing section, the magnetic attraction toward the fillpipe is not noticeably affected by such a thin face surface, so that the magnetic force available is efficiently utilized.

While a particular embodiment of this invention has been shown and described, it is obvious that changes and modifications can be made without departing from the true spirit and scope of the invention. It is the intention of the appended claims to cover all such changes and modifications.

The invention claimed is:

1. A vapor receiving system for use on a dispensing nozzle having a housing and a discharge spout, the vapor receiving system being designed to receive the vapors displaced through the fillpipe from the tank being filled and to be in fluid communication with a recepticle for receiving the vapors displaced from the tank, the vapor receiving system comprising:

(a) means defining a vapor receiving chamber surrounding the discharge spout of the nozzle and having one end for connection to the nozzle housing;

(b) a sealing section connected to the other end of the vapor receiving chamber and having a sealing face for meeting the fillpipe opening; and (c) means for covering the sealing face of the sealing section so that a tight seal is obtained between the fillpipe and the sealing face, said covering means including, (i) reinforcement means, and (ii) flexible material impregnating the reinforcing means to form a thin, smooth flexible layer wherein the reinforcement means in the flexible material enables maximum strength and flexibility to be imparted to the covering means to increase the probability of obtaining a tight seal between the sealing face and the fillpipe.

2. The vapor receiving system recited in claim 1, further comprising means for imparting resiliency to the covering means and including a layer of resilient material sandwiched between the sealing section and the covering means.

3. The vapor receiving system recited in claim 1, wherein the reinforcement means is a mesh layer made from either natural or synthetic fibers.

4. The vapor receiving system recited in claim 1, wherein the reinforcement means is a mesh layer made from a synthetic thermoplastic polymer.

5. The vapor receiving system recited in claim 1, wherein the flexible material impregnating the reinforcement means is made from a natural or synthetic elastomer.

6. The vapor receiving system recited in claim 1, wherein the vapor receiving chamber includes a bellows section in which the bellows structure comprises:

(a) means for reinforcing the bellows structure; and (b) flexible material impregnated in the reinforcing means to form a thin, flexible wall for the bellows structure wherein the reinforcing means in the flexible material enables maximum strength and flexibility to be imparted to the bellows section to provide sufficient flexibility for obtaining a tight seal with the fillpipe as well as to provide sufficient resistance to damage from normal use.

7. The vapor receiving system recited in claim 6, wherein the means for reinforcing the bellows structure is a mesh layer made from either natural or synthetic fibers.

8. The vapor receiving system recited in claim 6, wherein the means for reinforcing the bellows structure is a mesh layer made from a synthetic thermoplastic polymer.

9. The vapor receiving system recited in claim 6, wherein the flexible material impregnated in the reinforcing means is made from a natural or synthetic elastomer.

10. The vapor receiving system recited in claim 1, wherein the sealing section comprises:

(a) a magnetic disc having a hole for the discharge spout to pass therethrough and having sufficient space between the perimeter of the hole and the spout for fluid to pass through; and (b) means for increasing the magnetic force on the face side of the magnetic disc with respect to the magnetic force on the other side or back side of the magnetic disc, said means including a pole piece attached to the back side of the magnetic disc.

11. A vapor receiving system for use on a dispensing nozzle having a housing and discharge spout, the vapor receiving system being designed to receive the vapors displaced through the fillpipe from the tank being filled and to be in fluid communication with a recepticle for receiving the vapors displaced from the tank, the vapor receiving system comprising:

(a) means defining a vapor receiving chamber surrounding the discharge spout of the nozzle and having one end for connection to the nozzle housing, said vapor receiving chamber having a bellows section in which the bellows structure comprises:

(i) means for reinforcing the bellows structure, and (ii) flexible material impregnated in the reinforcing means to form a thin, flexible wall for the bellows structure wherein the reinforcing means in the flexible material enables maximum strength and flexibility to be imparted to the bellows section to provide sufficient flexibility for obtaining a tight seal with the fillpipe as well as to provide sufficient resistance to damage from normal use; and (b) a sealing section connected to the other end of the vapor receiving chamber and having a sealing face for meeting the fillpipe opening.

12. The vapor receiving system recited in claim 11, wherein the means for reinforcing the bellows structure is a mesh layer made from either natural or synthetic fibers.

13. The vapor receiving system recited in claim 11, wherein the means for reinforcing the bellows structure is a mesh layer made from a synthetic thermoplastic polymer.

14. The vapor receiving system recited in claim 11, wherein the flexible material impregnated in the reinforcing means is made from a natural or synthetic elastomer.

15. A liquid fuel dispensing nozzle having a vapor receiving system made from improved material for improving the sealing characteristics of the vapor receiving system with the fillpipe of the tank being filled, said nozzle comprising:

(a) a nozzle housing having means for controlling the dispensing of fuel through the nozzle;

(b) a fuel discharge spout connected at one end to the nozzle housing, for insertion into the fillpipe of the tank being filled;

(c) means defining a vapor receiving chamber surrounding the discharge spout of the nozzle and being connected at one end to the nozzle housing;

(d) a sealing section connected to the other end of the vapor receiving chamber and having a sealing face for meeting the fillpipe opening; and (e) means for covering the sealing face of the sealing section so that a tight seal is obtained between the fillpipe and the sealing face, said covering means including, (i) reinforcement means, and (ii) flexible material impregnating the reinforcing means to form a thin, smooth flexible layer wherein the reinforcement means in the flexible material enables maximum strength and flexibility to be imparted to the covering means to increase the probability of obtaining a tight seal between the sealing face and the fillpipe.

16. The liquid fuel dispensing nozzle recited in claim 15, further comprising means for imparting resiliency to the covering means and including a layer of resilient material sandwiched between the sealing section and the covering means.

17. The liquid fuel dispensing nozzle recited in claim 15, wherein the reinforcement means is a mesh layer made from a synthetic thermoplastic polymer 18. The liquid fuel dispensing nozzle recited in claim 15, wherein the flexible material impregnating the reinforcement means is made from a natural or synthetic elastomer.

19. The liquid fuel dispensing nozzle recited in claim 15, wherein the vapor receiving chamber includes a bellows section in which the bellows structure comprises:

(a) means for reinforcing the bellows structure; and (b) flexible material impregnated in the reinforcing means to form a thin, flexible wall for the bellows structure wherein the reinforcing means in the flexible material enables maximum strength and flexibility to be imparted to the bellows to provide sufficient flexibility for obtaining a tight seal with the fillpipe as well as to provide sufficient resistance to damage from normal use.

20. The vapor receiving system recited in claim 19, wherein the means for reinforcing the bellows structure is a mesh layer made from a synthetic thermoplastic polymer.

21. The vapor receiving system recited in claim 19, wherein the flexible material impregnated in the reinforcing means is made from a natural or synthetic elastomer.

22. A liquid fuel dispensing nozzle having a vapor receiving system made from improved material for improving the sealing characteristics of the vapor receiving system with the fillpipe of the tank being filled, said nozzle comprising:

(a) a nozzle housing having means for controlling the dispensing of fuel through the nozzle;

(b) a fuel discharge spout connected at one end to the nozzle housing, for insertion into the fillpipe of the tank being filled;

(c) means defining a vapor receiving chamber surrounding the discharge spout of the nozzle and being connected at one end to the nozzle housing, said vapor receiving chamber having a bellows section in which the bellows structure comprises:

(i) means for reinforcing the bellows structure, and (ii) flexible material impregnated in the reinforcing means to form a thin, flexible wall for the bellows structure wherein the reinforcing means in the flexible material enables maximum strength and flexibility to be imparted to the bellows section to provide sufficient flexibility for obtaining a tight seal with the fillpipe as well as to provide sufficient resistance to damage from normal use; and (d) a sealing section connected to the other end of the vapor receiving chamber and having a sealing face for meeting the fillpipe opening.

23. The liquid fuel dispensing nozzle recited in claim 22, wherein the means for reinforcing the bellows structure is a mesh layer made from a synthetic thermoplastic polymer.

24. The liquid fuel dispensing nozzle recited in claim 22, wherein the flexible material impregnated in the reinforcing means is made from a natural or synthetic elastomer.

* * * * *